US008113289B2

(12) United States Patent
White

(10) Patent No.: US 8,113,289 B2
(45) Date of Patent: Feb. 14, 2012

(54) FLOW REGULATOR FOR DOWNHOLE PROGRESSING CAVITY MOTOR

(75) Inventor: Billy W. White, Spring, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 202 days.

(21) Appl. No.: 12/689,382

(22) Filed: Jan. 19, 2010

(65) Prior Publication Data

US 2011/0174499 A1 Jul. 21, 2011

(51) Int. Cl.
*E21B 34/06* (2006.01)
*E21B 34/08* (2006.01)

(52) U.S. Cl. ..... 166/373; 166/319; 166/325

(58) Field of Classification Search ..... 166/319, 166/325, 373; 175/57, 317; 137/513.5, 517; 138/46; 418/48; 417/295, 441
See application file for complete search history.

(56) References Cited

U.S. PATENT DOCUMENTS

| | | | | |
|---|---|---|---|---|
| 3,974,876 | A | 8/1976 | Taylor | |
| 4,768,598 | A * | 9/1988 | Reinhardt | 175/26 |
| 5,282,490 | A | 2/1994 | Higgs | |
| 5,301,713 | A | 4/1994 | Skoglund | |
| 5,431,183 | A | 7/1995 | Seidl | |
| 6,053,196 | A | 4/2000 | Kortge | |
| 6,129,112 | A | 10/2000 | Huthmann et al. | |
| 6,854,953 | B2 * | 2/2005 | Van Drentham-Susman et al. | 415/36 |
| 2010/0000793 | A1 | 1/2010 | White | |

* cited by examiner

*Primary Examiner* — William P Neuder
*Assistant Examiner* — Ronald Runyan
(74) *Attorney, Agent, or Firm* — Streets & Steele

(57) ABSTRACT

A system for regulating the flow of fluid through a progressing cavity motor includes an annulus restriction (22) for restricting flow through the annulus passageway, and an annular biasing member (24) for biasing the annular restriction toward a closed position. Fluid flow in the annulus passageway creates an opening force on the annulus restriction. A central restriction (28) within the motor provides a restricted flow through the motor. A central biasing member (26) biases the central restriction toward an open position, with fluid flow in a central passageway exerting a closing force on the central restriction.

20 Claims, 4 Drawing Sheets

FLOW REGULATOR FOR DOWNHOLE PROGRESSING CAVITY MOTOR

FIELD OF THE INVENTION

The present invention relates to a device for regulating the amount of flow through a progressing cavity motor within a downhole collar and other tubular. The rotational speed of the progressing cavity motor is a direct function of the volumetric flow rate passing through the stator of the motor. By modulating this flow, the rotational speed of the system may be modulated to a predetermined rate.

BACKGROUND OF THE INVENTION

A generator has been designed and constructed for creating electrical energy downhole in an oil well. The generator is driven with a progressing cavity motor as opposed to more classical methods, such as turbines. The progressing cavity motor is mechanically linked to the generator with a semi-rigid shaft. This shaft, referred to as a "flex shaft" is rigid enough to transmit a required amount of torque yet flexible enough to accommodate the eccentric neutation of the progressing cavity motor. The flex shaft in turn drives an electrical generator generally comprised of permanent magnets rotating about or within windings of an electrically conductive material such as copper wire. This results in the creation of an electrical charge capable of producing enough current to sustain electrical downhole instrumentation or other electrical devices. Further details regarding this generator are disclosed in Ser. No. 12/167,003 filed Jul. 2, 2008.

For a plurality of reasons, drilling fluid is pumped through the tubular string containing one or more drill collars from a pump located on the surface. A portion of this fluid is forced through the progressing cavity motor (pcm) located within a drill collar as the fluid travels downhole to pass to the drilling bit and return to the surface. The rotational speed of the pcm is directly proportional to the amount of fluid passing through the pcm. Under normal operations, this proportional amount is a minor portion of the total flow being supplied by the surface pump and passing through the drill collar.

In the process of drilling, the drilling mud may be pumped over a fairly wide flow range. This flow range may be 200 gallons per minute (gpm), up to and including 600 gpm. The output from the motor, however, desirably is a constant value. Flow through the pcm may be as much as 80 gpm or more.

While various designs exist for regulating fluid flow and pressure, this system modulates internal flow of drilling fluid within the motor. Substantially different yet related devices are taught in U.S. Pat. Nos. 3,974,876; 5,282,490; 5,301,713; 5,431,183; 6,053,196, and 6,129,112.

The disadvantage of the prior art is overcome by the present invention, an improved flow regulator for downhole pcm is hereinafter disclosed.

SUMMARY OF THE INVENTION

In one embodiment, a system for regulating the fluid flow through a progressing cavity motor positioned downhole within a tubular includes an annulus restriction for restricted flow through an annulus passageway radially outward of the motor, and an annular biasing member for biasing the annulus restriction toward the closed position. Fluid flowing in the annulus exerts an opening force on the annulus restriction. The system further includes a central passageway through the motor for restricting flow, and a central biasing member for biasing the central restriction toward an open position, with fluid flow in the central passageway exerting a closing force on the central restriction. The system is particularly well-suited for providing a constant rpm for a downhole motor to power an electrical generator.

These and further features and advantages of the present invention will become apparent from the following detailed description, wherein reference is made to the figures in the accompanying drawings.

DETAILED DESCRIPTION OF PREFERRED EMBODIMENTS

Figure 1:
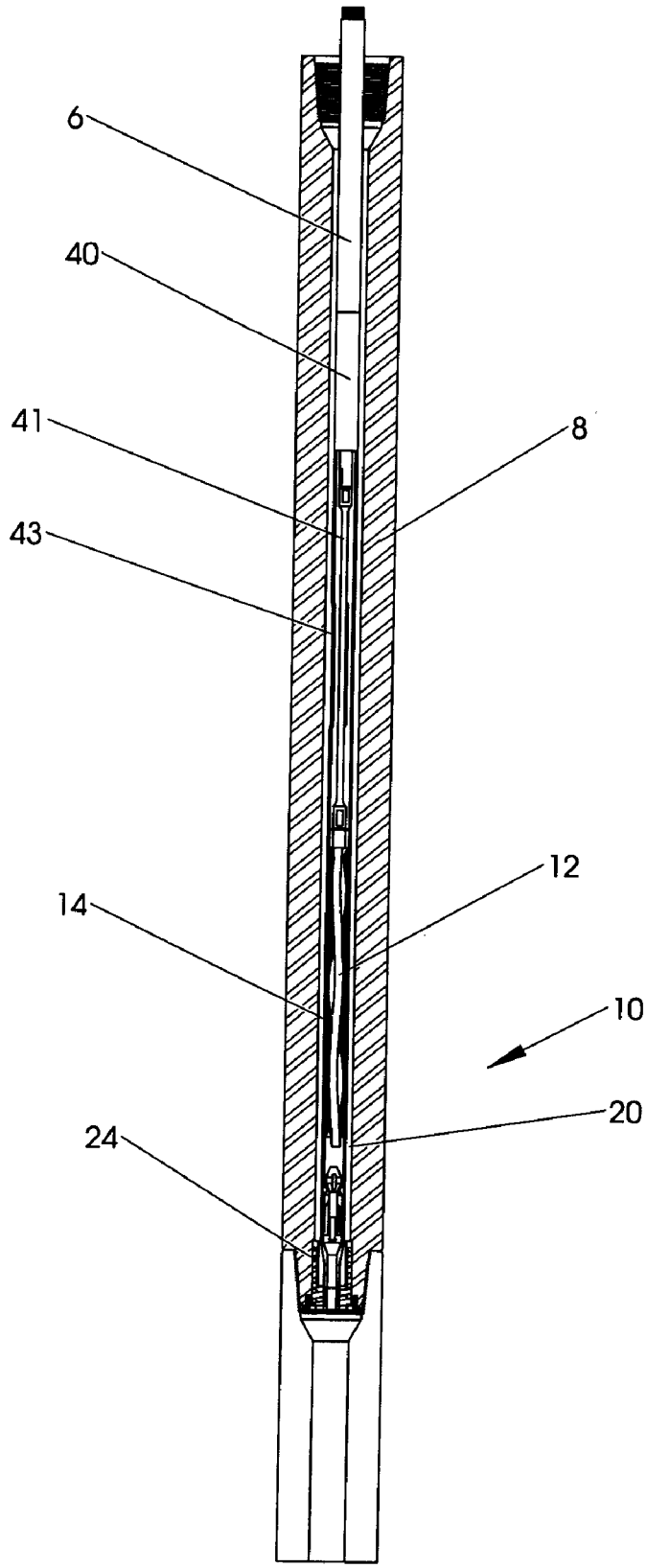
FIG. 1 is a cross-sectional view of a progressing cavity pump powering an electrical generator.
Figure 2:
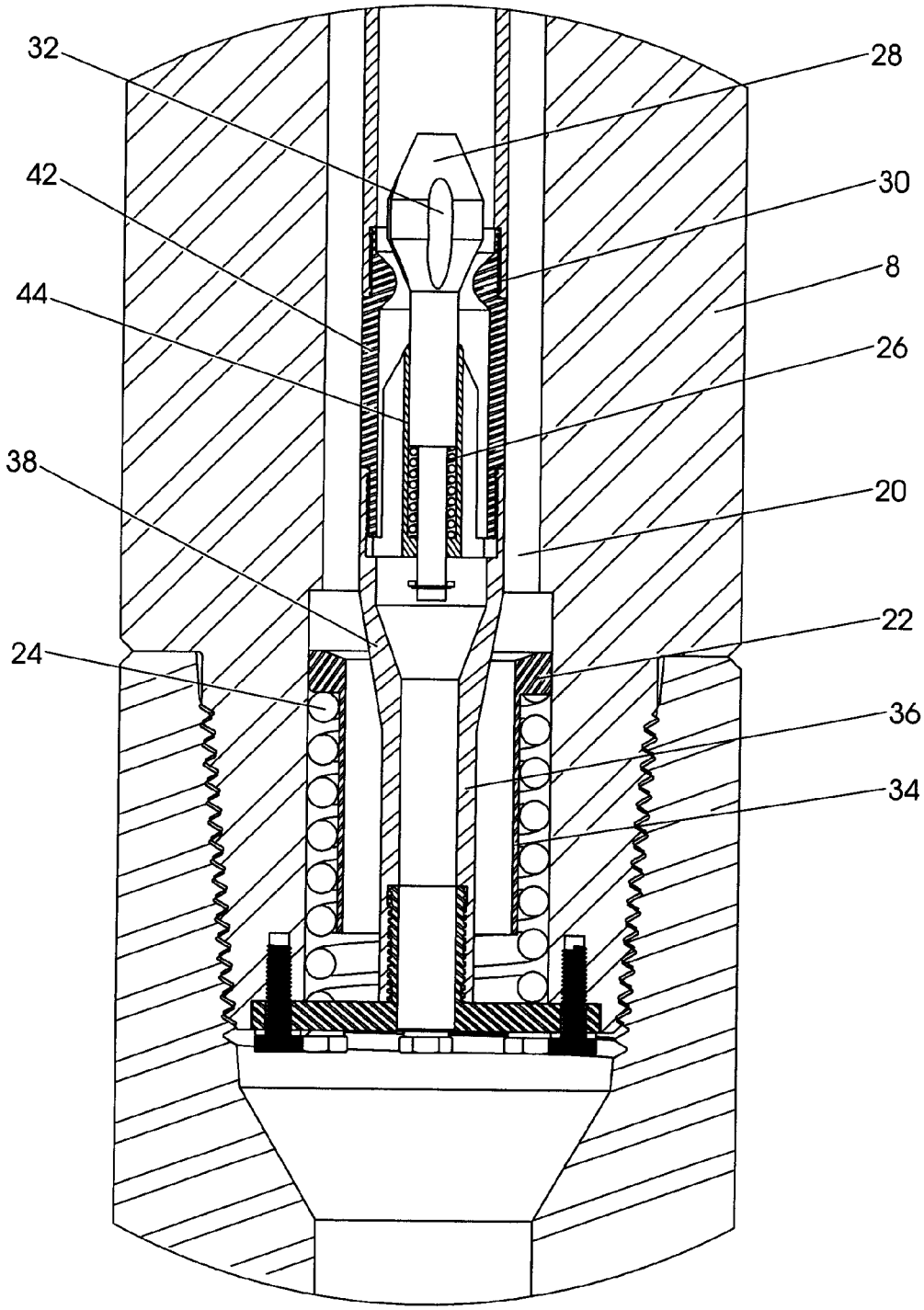
FIG. 2 is a more detailed view of a portion of the pump shown in FIG. 1.

The present invention provides a system to achieve modulation of flow through a downhole motor while the flow outside the motor may vary. FIG. 1 shows a sectional view of the system for regulating fluid flow through a progressing cavity motor 10. The motor 10 may be suspended in the well from a work string 6. The system uses a pressure differential across the motor for rotating the rotor 12 with respect to stator 14. This pressure drop is also created in the annulus 20 between the O.D. of the stator 14 and the I.D. of the tubular 8 enclosing the motor 10, with a spring loaded restriction 22, as shown in FIG. 2. The tubular 8 at this depth is commonly a drill collar. This restriction is appropriately sized such that at the lower end of the flow spectra, the spring 24 will force the annular opening to its minimum, creating a greater pressure drop. As the annular flow is increased, the increased pressure drop across the restriction creates a larger force and the spring 24 is depressed, opening the restriction. Thus, the pressure drop in the annulus is largely proportional to the amount of fluid being forced through the annulus. The annular flow typically may be several magnitudes greater than the flow through the motor.

FIG. 2 depicts both the annular spring 24 and the inner smaller spring 26 partially depressed. Fluid flowing through the interior of the motor must pass by a central restriction 28, which cooperates with reduced diameter neck portion 30. Restriction 28 contains a plurality of circumferentially spaced recesses 32, which allow minimum flow past the restriction even if the restriction 28 is fully seated in a closed position on the neck portion 30. These recesses 32 provide continuous flow through the motor regardless of the axial position of the restriction with respect to neck portion 30. Unlike the annular restriction 22, as the flow is increased, the restriction 28 is forced toward it maximum resistance. The restriction 22 is positioned within the annulus 20, and is biased toward a closed position by the spring 24. The depression of the smaller inner spring 26 is a function of the drag force on the obstruction. FIG. 2 shows the system in what would be a steady state position for a given flow within the operational range. Both springs 24, 26 are thus sized in conjunction with the geometry of both the annular and inner flow restrictors to give a dynamic balance for a desired flow condition.

The inner, smaller spring 26 and its flow restriction 28 are designed such that once a steady state flow is established, flow through the motor 10 is at a substantially constant rpm, thereby applying a constant rpm to electrical generator 40 powered by the motor. As shown in FIG. 1, generator 40 is provided above the motor, with a flex shaft 41 interconnecting the top of the rotor 12 with the generator 40. A plurality of circumferentially spaced gaps 43 are provided in the tubular enclosing the flex shaft 41, and allow fluids in the annulus between the work string 6 and the drill collar 8 to pass freely to and through the stator of the motor. In other embodiments, the generator 40 may be provided below the motor 10. As the electrical load on the generator increases, the rpm is slowed and the flow through the tool will begin to be inhibited. If the inner flow is inhibited, the inner spring 26 will drive the obstruction to a more open position, allowing more fluid through the inner passage of the motor, thereby bringing the rpm back to the desired state. Likewise, should the generator's electrical load drop, the rpm will accelerate, allowing more fluid to pass through the inner portion of the tool. In turn, the inner restriction 28 will be driven to a more restrictive position, thus lowering the motor rpm.

The outer larger spring 24 is used to create a usable pressure drop across the motor for a spectrum of flow rates of drilling mud. The inner, smaller spring 26 is used to regulate the rpm of the pcm. Both springs are designed to act synchronously to produce a steady state flow condition.

As shown in FIGS. 1 and 2, the motor 10 may be positioned within upper collar 8. The upper collar may have a mortise machined to accept a flanged stabilizer secured with bolts. The typical upper collar may have a 2 13/16" bore with a 6 5/8 IF machined drill collar joint.

Each of the annular restriction and the central restriction are biased axially in a selected direction, and preferably the axial bias is provided by a coil spring. Each of the annular restriction and the central restriction thus move axially relative to a conical shaped member to vary the flow past the restriction. More particularly, as shown in FIG. 2, the annular restriction 22 has a lower sleeve portion 34 for containing the spring 24. The lower end of the motor 10 includes a sleeve-shaped member 36, which in turn is bolted to the lower end of the drill collar, and contains a frustoconical portion 38 which has an exterior surface with a diameter increasing in an axially upward direction. As the restriction 22 moves upward relative to the conical section 38, flow area is reduced. Sleeve-shaped member 42 in turn is positioned above the upper end of sleeve 36, and preferably above the conical section 38 discussed above. The central restriction 28 is guided by sleeve 44 for axial movement, and moves downward to compress the spring 26 as a restriction moves toward the neck portion 30.

Figure 3:
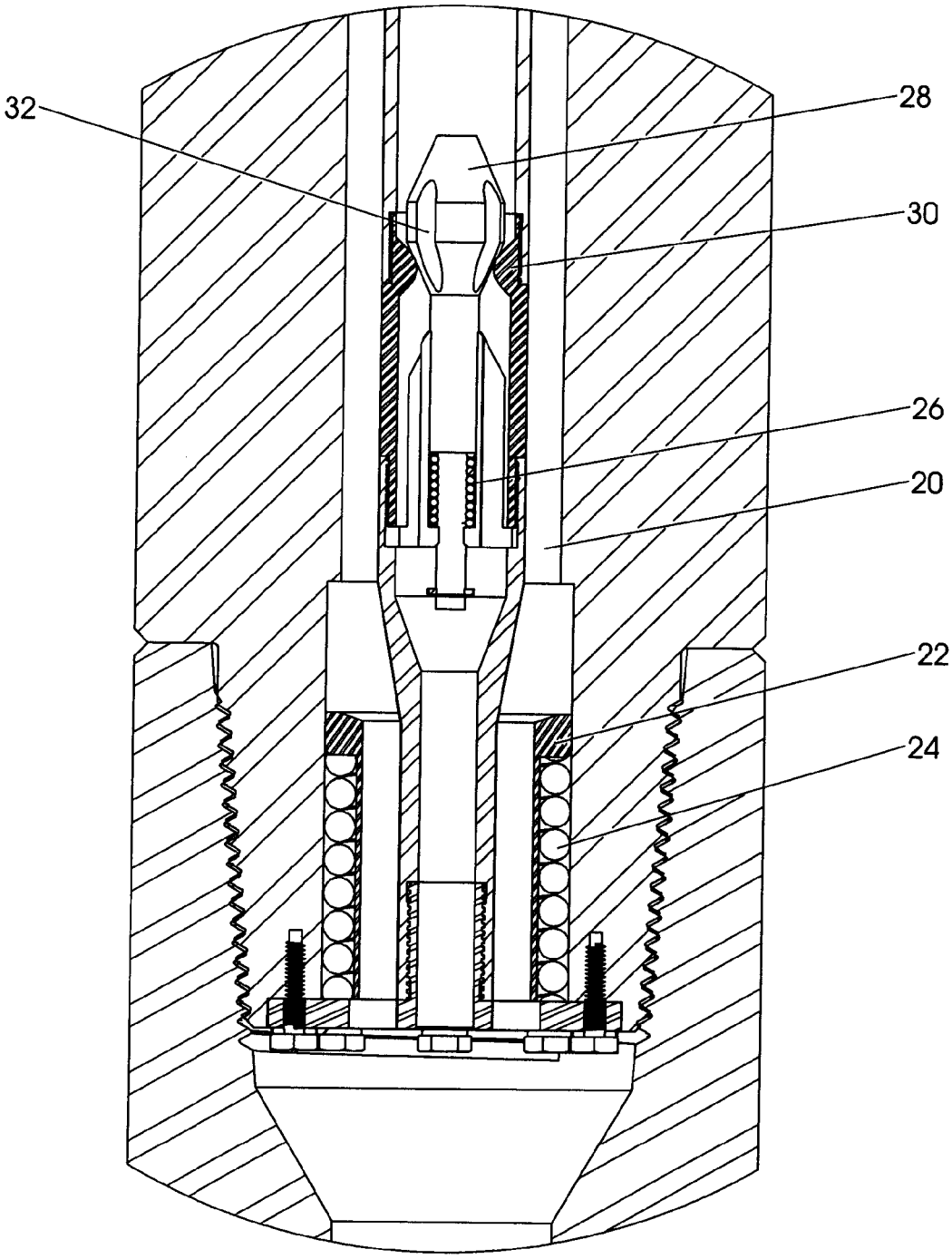
FIG. 3 is a cross-sectional view with substantially no flow through the pump.

FIG. 3 represents a maximum flow condition. Referring now to FIG. 3, the inner restriction 28 is seated on the neck portion 30, although preferably limited flow through the progressing cavity motor is provided by the circumferentially-spaced flow passageways 32. In FIG. 3, the spring 26 is thus fully compressed, and the spring 24 is also fully compressed since the annulus retainer 22 is forced downward by fluid pressure passing through the annulus.

Figure 4:
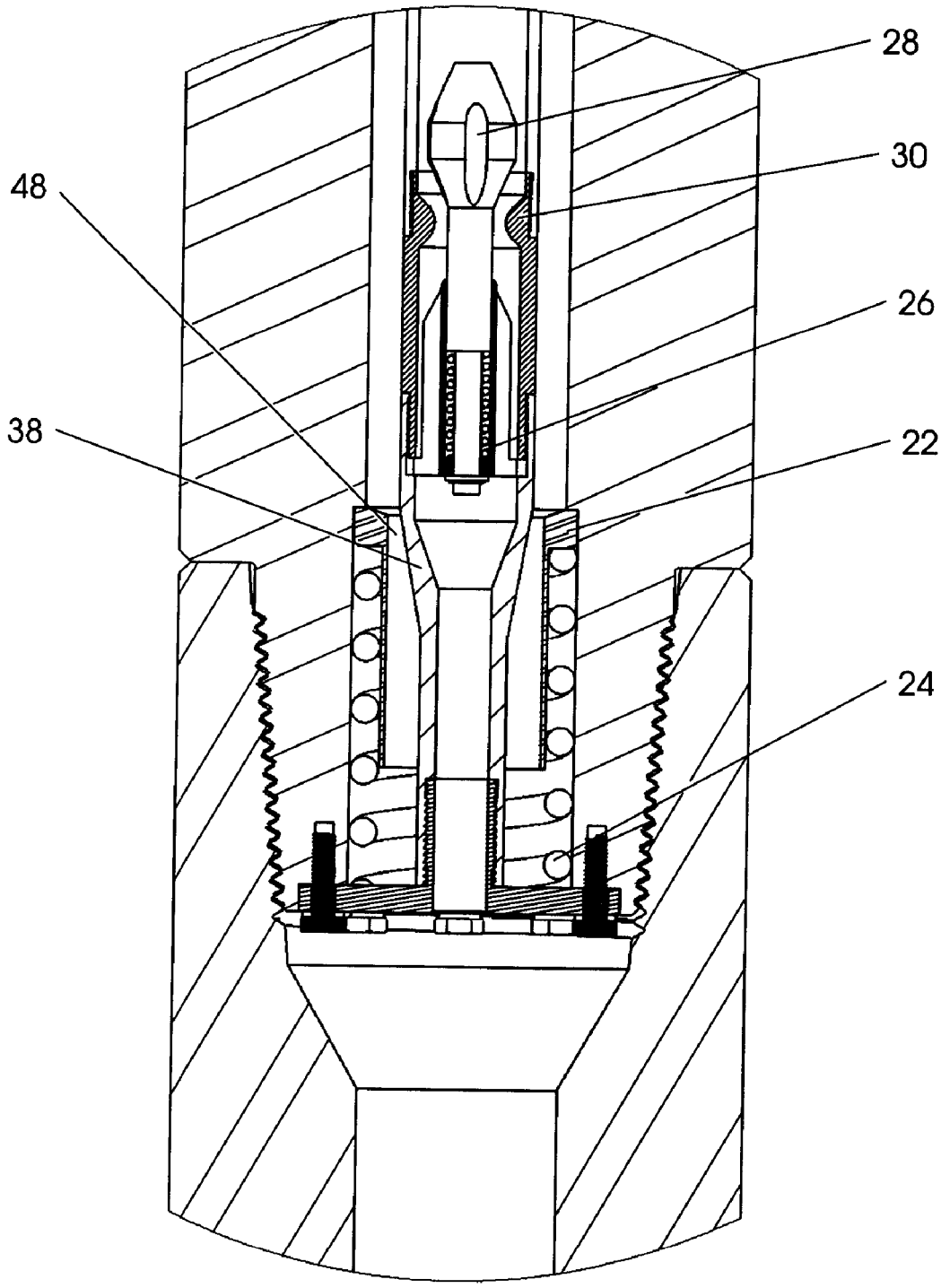
FIG. 4 is a cross-sectional view with maximum flow through the pump.

FIG. 4 represents a minimum flow condition. In FIG. 4, the annulus spring 24 is fully extended to minimize flow through the annulus 20, although gap between restriction 22 and conical portion 38 preferably still allows some fluid to pass through the annulus 20 and thus bypass the motor. In FIG. 4, spring 26 is fully extended, biasing the central restriction 28 away from the neck portion 30 to allow maximum flow through the motor.

According to the present invention, the annular biasing element provides a biasing force proportional to the opposing mildly movable due to the flow rate through the annulus passageway acting on the axially movable annulus restriction 22, so that the biasing force increases with increased flow through the annular passageway. Similarly, the central biasing element provides a biasing force which is proportional to the force due to the flow rate through the central passageway acting on the axially movable central restriction 24, so that the central biasing force will increase with increased flow through the central passageway. The annulus biasing member 24 biases the annular restriction or valve member 22 upward toward the conical seat 38, although in alternate embodiments an inward protrusion could be provided on the interior of the drill collar 8, in which case an annular biasing member may bias the valve member toward a seat which has a larger diameter than the largest restriction of the valve member.

The present invention is considered significantly better than concepts which utilize a more traditional governor with spinning weights to control fluid flow. In this application, such a governor concept would be difficult to achieve with the available diametrical space of a downhole progressing cavity motor, and the reliability of such a system would be questionable in view of acessibility and bearing problems associated with a spinning weight design.

A significant advantage of the present invention is that the system generates a substantially constant rpm for the output of progressing cavity motor which then results in a substantially constant voltage output from the electrical generator. Downhole tools which are powered by the electrical generator have a known voltage requirement, and thus a substantially constant voltage may be obtained from the generator without driving the motor at an excess speed, which may cause excessive, premature wear, as well as producing a higher than desired voltage. In the latter case, the additional voltage would have to be discarded, and may present significant problems with respect to heating down hole.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for regulating the flow of fluid through a progressing cavity motor having a stator and a rotor, the motor positioned downhole within a tubular in a well, comprising:

a radial gap between the tubular and the stator forming an annulus passageway radially outward of the motor, and a progressing cavity between the rotor and the stator forming a central passageway fluidly in parallel with the annulus passageway and rotating the rotor with respect to the stator;

an annulus restriction for restricting flow through the annulus passageway;

an annular biasing member for biasing the annulus restriction toward a closed position, and fluid flow in the annulus passageway creating an opening force on the annulus restriction;

a central restriction for restricting flow through the central passageway; and a central biasing member for biasing the central restriction toward an open position, and fluid flow in the central passageway exerting a closing force on the central restriction.

2. The system as defined in claim 1, wherein the annular biasing member exerts a biasing force on the annulus restriction greater than the force exerted on the central restriction by the central biasing member.

3. The system as defined in claim 1, wherein the rotor powers an electrical generator.

4. The system as defined in claim 1, wherein each of the annular biasing member and the central biasing member is a coiled spring.

5. The system as defined in claim 1, wherein the central restriction includes one or more passageways for limited flow through the central passageway when the central restriction is in a closed position.

6. The system as defined in claim 1, wherein the central restriction moves axially to vary flow through the central passageway.

7. The system as defined in claim 1, wherein the annulus restriction moves axially relative to a conical member to vary flow through the annulus passageway.

8. A system for regulating the flow of fluid through a progressing cavity motor having a central axis, a stator and a rotor, and thereby providing a substantially constant rpm from the rotor to a downhole electrical generator powered by the motor, the motor positioned downhole within a tubular in a well, comprising:

a radial gap between the tubular and the stator forming an annulus passageway radially outward of the motor, and a progressing cavity between the rotor and the stator forming a central passageway fluidly in parallel with the annulus passageway and rotating the rotor with respect to the stator;

a first restriction movable along the central passageway for restricting flow through the annulus passageway;

a first biasing member for biasing the first restriction toward a closed position, and fluid flow in the annulus passageway creating an opening force on the first restriction;

a second restriction movable along the central passageway for restricting flow through the central passageway; and a second biasing member for biasing the second restriction toward an open position, and fluid flow in the central passageway exerting a closing force on the second restriction.

9. The system as defined in claim 8, wherein the first biasing member provides a biasing force proportional to the force due to the flow rate through the annular passageway acting on the first restriction, and the central biasing member provides a biasing force proportional to the force due to the flow rate through the central passageway acting on the second restriction.

10. The system as defined in claim 8, wherein each of the first biasing member and the second biasing member is a coiled spring.

11. The system as defined in claim 8, wherein flow through the annulus passageway is combined with flow through the central passageway after passing through the motor.

12. The system as defined in claim 8, wherein the second restriction includes one or more side ports for limited flow through the central passageway when the second restriction is in the closed position.

13. The system as defined in claim 8, wherein the first restriction moves axially relative to a central conical member to vary flow through the annulus passageway.

14. A method of regulating the flow of fluid through a progressing cavity motor having a stator and a rotor, the motor positioned downhole within a tubular in a well, comprising:

providing a radial gap between the tubular and the stator to form an annulus passageway radially outward of the motor, and a progressing cavity between the rotor and the stator forming a central passageway fluidly in parallel with the annulus passageway and rotating the rotor with respect to the stator;

restricting flow through the annulus passageway with an annulus restriction;

biasing the annulus restriction toward a closed position with an annulus biasing member, and fluid flow in the annulus passageway creating an opening force on the annulus restriction;

restricting flow through the central passageway with a central restriction; and biasing the central restriction toward an open position with a central biasing member, and fluid flow in the central passageway exerting a closing force on the central restriction.

15. The method as defined in claim 14, wherein the central restriction moves axially to vary flow through the central passageway.

16. The method as defined in claim 14, wherein the annulus restriction moves axially relative to a conical member to vary flow through the annulus passageway.

17. The method as defined in claim 14, wherein the central restriction includes one or more passageways for limited flow through the central passageway when the central restriction is in a closed position.

18. The method as defined in claim 14, wherein each of the annular biasing member and the central biasing member is a coiled spring.

19. The method as defined in claim 14, wherein an electrical generator is powered by the motor.

20. The system as defined in claim 14, wherein the annulus biasing member provides a biasing force proportional to the force due to the flow rate through the annular passageway acting on the annulus restriction, and the central biasing member provides a biasing force proportional to the force due to the flow rate through the central passageway acting on the central restriction.

* * * * *